US005915937A

United States Patent [19]

Christensen

[11] Patent Number: 5,915,937

[45] **Date of Patent: *Jun. 29, 1999**

[54] PRIMARILY INDEPENDENT COMPOSITE/ METALLIC GUN BARREL

[75] Inventor: Roland Christensen, Fayette, Utah

[73] Assignee: Roland J. Christensen Family Limited Partnership, Fayette, Utah

[ * ] Notice: This patent is subject to a terminal disclaimer.

[21] Appl. No.: 08/876,408

[22] Filed: Jun. 16, 1997

Related U.S. Application Data

[63] Continuation of application No. 08/574,402, Dec. 18, 1995, Pat. No. 5,692,334.

[51] Int. Cl.[6] ..... F41A 21/02

[52] U.S. Cl. ..... 42/76.02; 42/78; 89/16; 89/15; 89/14.1

[58] Field of Search ..... 42/76.01, 78, 76.02, 42/77; 89/15, 16, 14.05, 14.1

[56] References Cited

U.S. PATENT DOCUMENTS

| | | | |
|---|---|---|---|
| 5,125,179 | 6/1992 | Campbell et al. | 42/76.02 |
| 5,448,848 | 9/1995 | Moller | 42/77 |
| 5,692,334 | 12/1997 | Christensen | 42/76.02 |

FOREIGN PATENT DOCUMENTS

| | | | |
|---|---|---|---|
| 1167676 | 5/1984 | Canada | 89/16 |
| 766787 | 1/1957 | United Kingdom | 42/76.02 |

*Primary Examiner*—Stephen M. Johnson
*Attorney, Agent, or Firm*—Thorpe, North & Western, L.L.P.

[57] ABSTRACT

A substantially nonbonded composite/metallic gun barrel is disclosed. The gun barrel has a metallic liner and a composite casing disposed thereabout. Unlike composite/metallic gun barrels of the prior art, the embodiments of the present invention provide little if any bonding between the composite casing and the metallic liner so as to decrease the warping of the gun barrel caused by the differing thermal expansion coefficients of the composite material and the metallic liner. In accordance with one aspect of the invention, a short binding layer is used to hold the composite casing to the metallic liner adjacent the chamber which holds a cartridge to be fired. The short layer prevents rotation of the casing and the liner with respect to one another, while preventing little risk of warping. In accordance with another aspect of the invention, a holding pin is inserted in the gun barrel to prevent the metallic liner and the composite casing from rotating relative one another.

9 Claims, 3 Drawing Sheets

PRIMARILY INDEPENDENT COMPOSITE/ METALLIC GUN BARREL

This application is a continuation of application Ser. No. 08/574,402, filed Dec. 18, 1995, now U.S. Pat. No. 5,692, 334.

BACKGROUND OF THE INVENTION

The present invention relates to a gun barrel made of a composite material and a metallic material, and specifically to a gun barrel having a metal lining and a fiber/resin composite casing which are disposed coaxially and primarily unbonded for a substantial length of the barrel so as to avoid inaccuracy and inconsistency caused by differing coefficients of thermal expansion between the metallic liner of the barrel and the composite barrel or casing.

It has long been known that forming a gun barrel out of a composite material provides advantages over traditional gun barrels made of metal. Two primary advantages are that the composite barrel is substantially lighter than the metallic barrel, and is considerably stiffer.

Typically, however, it has been found that a gun barrel which is made of both metal and a composite material is superior to those made entirely of either substance for two reasons. First, the metallic barrel liner provides a hard, machinable surface for spiral riflings in the liner bore which provide a rotational spin to the bullet during flight and greatly improves accuracy. In contrast, the composite material is not sufficiently hard, is friable, and is generally unsuitable for barrel riflings.

Second, when a bullet is fired, it is expelled from the barrel by the combustion of materials contained in the cartridge. As these materials burn, they emit gasses which force the bullet through the barrel and out an opposing end from where the cartridge is held. These gasses are extremely hot and are generally corrosive. To protect the fiber/resin composite materials from these gasses, it has become common-place to dispose a thin metallic barrel liner inside and coaxially with the composite barrel or casing material. The metallic liner of the barrel prevents the hot, corrosive gasses from contacting the composite materials, thus extending the life of the barrel.

One major problem with such metallic/composite gun barrels is that the two materials have different coefficients of thermal expansion. Due to the heat generated when firing each bullet, a barrel can quickly become warm. If rounds are repeatedly fired within a short time period, the barrel of the gun may become very hot. If the materials which form the barrel of the gun have substantially different coefficients of thermal expansion, the heat generated by repeated firing heats up the barrel which causes the metallic liner and the composite portion to expand at different rates. Those skilled in the art will appreciate that the stress developed between a metallic barrel liner bonded to a composite barrel or casing can decrease accuracy and consistency of the gun.

When a composite/metal barrel is formed, the metallic liner is generally overlaid with a composite material which has been impregnated with a binding resin, usually epoxy. The binding material solidifies the composite material to form the outer portion of the barrel or casing. The binding material will also typically bind the composite material to the metal portion. If the composite portion is formed on a mandrel, instead of directly on the metallic barrel, a bonding agent is typically used to bind the composite portion of the barrel to the metallic liner.

In such a formation, however, the bonding resin or epoxy material often prevents even contraction or expansion of the metallic liner relative to the composite portion. Often this occurs because of the differing rates of thermal expansion of the composite and metal due to the heat generated during firing. Such thermal stresses often cause the resin or bonding agent to break free of the metallic liner in a fragmented and uneven manner. When one segment of the metallic liner remains bonded to the composite portion and an opposing segment does not, the barrel will warp under the heat of firing. This decreases the accuracy of the weapon and can result in premature failure of the barrel.

Thus, there is a need for a gun barrel which incorporates the advantages of a metallic/composite gun barrel, while minimizing the problems posed by using materials which have substantially different coefficients of thermal expansion.

SUMMARY OF THE INVENTION

Thus, it is an object of the present invention to provide a gun barrel for use with small arms which is lightweight and durable.

It is another object of the present invention to provide a gun barrel which is inexpensive to manufacture.

It is an additional object of the present invention to provide a gun barrel which does not lose accuracy and consistency due to heat generated during repeated firing within a short period of time often called barrel droop. The barrel may move in any direction due to stresses induced during metal formation and relieved during repeated firing of a hot barrel.

It is yet another object of the present invention to provide a metallic/composite barrel which allows the metallic and composite portions of the barrel to expand and contract at different rates without creating additional stress within the barrel.

The above and other objects of the invention are realized in specific illustrated embodiments of a primarily independent composite/metallic gun barrel including a generally cylindrical metallic barrel liner and a composite barrel casing disposed about an exterior of the metallic barrel liner so that a substantially nonbonded interface exists between the liner and the casing and thus the barrel. In other words, unlike conventional composite/metallic barrels in which a bonding agent is coated about the metallic liner so as to bond the metallic liner and the composite material, the present invention omits the bonding agent uniformly for substantially the length of the barrel. By substantially is meant more than half of the length of the barrel.

In accordance with one aspect of the invention, the metallic liner and the composite casing are not bonded along the entire length of the barrel portion. As expansion or contraction of the barrel occurs, the metallic liner is able to expand or contract at a different rate and to a different extent than the composite casing without creating stress in the barrel. Because the metallic liner of the barrel and the composite casing of the barrel are independent and not bonded, the barrel does not deform or warp as do the barrels of the prior art, and the accuracy of the barrel is maintained.

In accordance with another principle of the invention, the composite material is attached to the metallic liner adjacent to one end of the barrel, typically adjacent to the chamber of the gun, but not for the remainder of the barrel. Preferably, the bonded segment will be no more than 4 inches, and preferably 2 to 3 inches. The bonded segment adjacent the chamber of the gun allows the two portions of the barrel to be held properly in place, while allowing the metallic liner and composite portion to move freely with respect to one another for the remainder of the barrel. Because of the short length of the bonded segment, the barrel is able to avoid warping and retain its accuracy.

In accordance with another aspect of the present invention, the composite casing of the barrel is formed on a mandrel separate from the metallic liner. The composite casing is then cured and the mandrel removed. The metallic liner is then slid into the composite casing so as to form a gun barrel in which the metallic liner and the composite casing are not bonded together, or are bonded along only a short segment of the barrel as described above.

In accordance with yet another aspect of the present invention, the gun barrel is formed by forming a metallic liner and coating the liner with a release agent. The composite material is then overlaid on the metallic liner to form the composite portion of the gun barrel. Once the composite portion has cured, the gun barrel is subjected to pressures, temperatures, et cetera, which cause the bonding material to move or otherwise pull free of the metallic liner for the length of the barrel. When the gun barrel is subjected to changes in temperature, the lack of bonding allows the metallic liner to expand and contract independently from the composite casing of the barrel.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
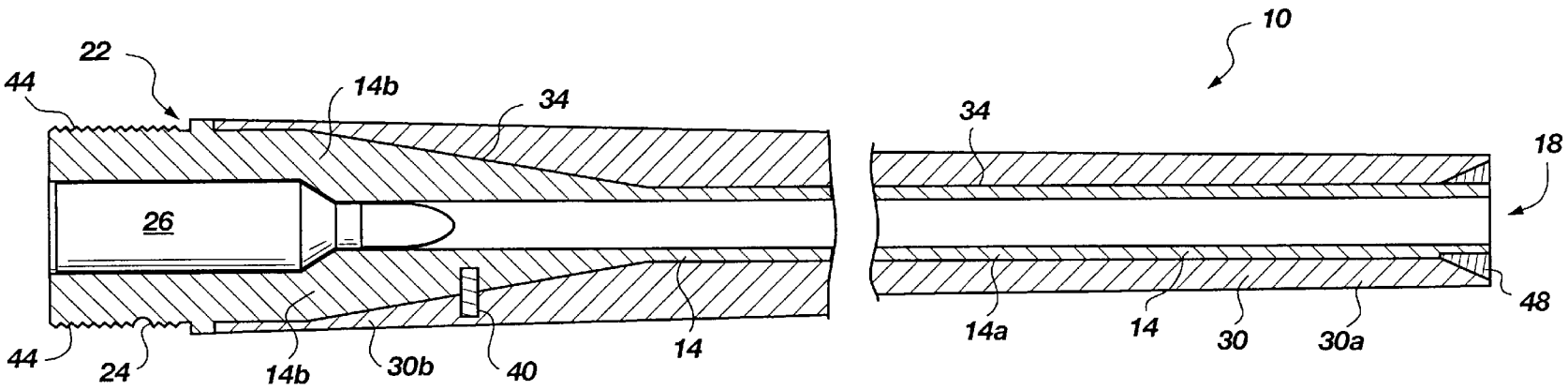
FIG. 1 shows a fragmented, side cross-sectional view of a gun barrel made in accordance with the principles of the present invention.

Referring to FIG. 1, there is shown a composite/metallic gun barrel, generally indicated at 10, made in accordance with the principles of the present invention. The composite/metallic gun barrel 10 has an elongate metallic cylinder 14 which forms a liner for the gun barrel 10. This metallic liner 14 is typically made of stainless steel, but can be made of other metals as well.

The metallic liner has a first, thin walled portion 14*a* which extends from an open, first end 18 to a position two to four inches from a second end 22 which forms a chamber 24 for receiving a cartridge 26. From the position at which the first, thin walled portion 14*a* ends, a second portion 14*b* of the metallic liner 14 has an increased thickness, as shown in FIG. 1. The thicker walls of the second portion 14*b* form the chamber 24 for receiving the cartridge 26. The thicker walls also provide additional support to compensate for the explosive force caused by firing the cartridge 26.

Wrapped about the metallic liner 14 is a casing 30 made of a fiber/resin composite material. While the composite material will typically be a graphite "prepreg", or graphite fibers coated with epoxy, other composite fibers and/or resins may be used as is known to those skilled in the art. The casing 30 has a first, thick walled section 30*a* which extends along the barrel 10 for the length of the first, thin walled portion 14*a* of the metallic liner 14. Adjacent the second portion 14*b* of the metallic liner 14, a second section 30*b* tapers to a thinner wall to match the increase in thickness in the metallic liner 14.

At the exterior circumference of the metallic liner 14 and the interior circumference of the composite casing 30 is an interface 34. In prior art composite/metallic gun barrels, the metallic liner 14 and the composite casing 30 were bonded together along the length of the interface. If the composite casing 30 was formed on the metallic liner 14, the bonding was usually achieved by the epoxy or other resin used to bond the composite fibers. If the composite casing 30 was formed on a mandrel, or some other device, and then placed on the metallic barrel liner, the bonding was typically accomplished by coating the metallic liner with a bonding material.

As was discussed in the background section, the variation in bond strength due to uneven application between the metallic liner 14 and the composite casing 30 leads to uneven stresses during expansion and contraction due to both atmospheric changes, and the heat generated by repeated firing of the weapon. During the expansion and contraction of the metallic barrel liner 14 and the composite barrel casing 30, it is common for some of the bonding material to break free of the composite casing or the metallic liner.

When some, but not all of the bonding material breaks free of the casing 30 or the liner 14, portions of the casing and liner pull against one another, while other portions are able to freely move. This results in the barrel 10 warping under the differing stresses. The warping, in turn, decreases the accuracy of the gun and causes increased friction between the metallic barrel liner and a bullet passing therethrough.

In contrast to the prior art, the present invention does not bond the metallic liner 14 and the composite casing 30 together along the entire length of the barrel 10. In the embodiment shown in FIG. 1, no bonding agent is used along the entire length of the interface 34 between the composite casing 30 and the metallic liner 14. In the alternative, the composite casing 30 and the metallic liner 14 can be freed from bonding together by use of a release agent such as TEFLON spray to provide a nonbonded interface 34 between the composite casing 30 and the metallic liner 14.

Disposed along the second section 30*b* of the composite casing 30 and the second portion 14*b* of the metallic liner 14 is a holding pin 40 which extends into the metallic liner and the composite casing. The holding pin 40 is disposed in a position which prevents rotation of the composite casing 30 relative to the metallic liner 14. The holding pin 40 can be made of numerous different materials, but steel is believed to be a preferred material.

Also shown in FIG. 1 is a standard threaded barrel mounting 44 at an end of the second portion 14*b* of the metallic liner 14 opposite the first portion 14*a*. The threaded barrel mounting 44 allows the barrel to be mounted to a conventional machined metal action.

A threaded tapered pre-stress insert 48 is also shown, the insert being disposed adjacent the open, first end 18 of the barrel 10. The pre-stress insert 48 is typically made of stainless steel, although those skilled in the art will be familiar with other materials which could be used. The pre-stress insert stretches the barrel in advance of thermal expansion and thereby minimize the effects of the thermal expansion.

Figure 2:
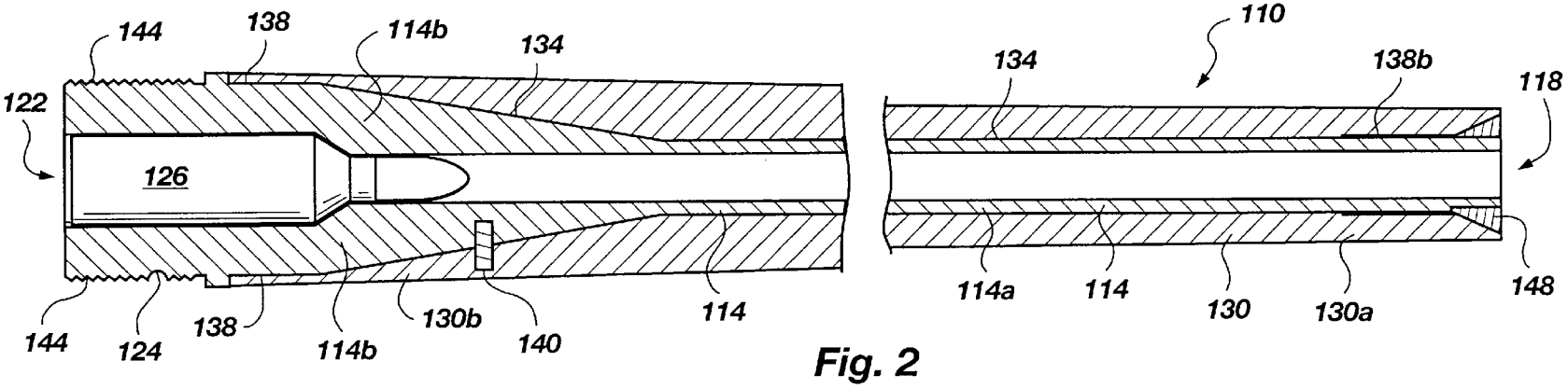
FIG. 2 shows a fragmented, side cross-section view of another embodiment of a gun barrel in accordance with the principles of the present invention.

Referring now to FIG. 2, there is shown an alternate embodiment of the invention. Similar to the embodiment shown in FIG. 1, the embodiment shown in FIG. 2 has a barrel 110 having a metallic liner 114 and a composite casing 130 made of graphite or some other fibrous material as will be apparent to those skilled in the art.

The metallic liner has a first, thinner walled portion 114*a* near an open first end 118 of the barrel 110, and a second, thicker walled portion 114*b*, adjacent a second end 122 of the barrel. The second, thicker walled portion 114*b* forms a chamber 124 for receiving a cartridge 126. Unlike the embodiment shown in FIG. 1, however, the interface 134 between the metallic liner 114 and the composite casing 130 is bonded along a portion thereof. Disposed along the interface 134 between the second portion 114*b* of the metallic liner 114 and the second section 130*b* of the composite casing 130 is a bonding layer 138. The bonding layer will typically be a layer of epoxy, but may be made of other bonding agents as well.

The bonding layer 138 holds the second section 130*b* of the composite casing 130 to the second portion 114*b* of the metallic liner 114 so as to prevent rotation of the casing relative to the liner, and to prevent the two from separating. The bonding layer 138, however, will typically be uniformly displaced around the barrel for a length of only two or three inches. Over such a length, the expansion and contraction of the composite casing 130 and the metallic liner 114 presents a lower risk of warping the barrel. At least a substantial portion of the remaining length of the interface 134 between the composite casing 130 and the metallic liner 114 is not bonded so as to allow the casing and the liner to expand and contract independently of one another.

Those skilled in the art will recognize that gun barrels could achieve some of the advantages of the present invention while using a bonding layer extending a greater length. For example, the bonding layer 138 could be half the length of the barrel 110, while still achieving some benefit by allowing the liner and casing of the remaining, nonbonded length of the barrel to move relative to one another. However, it is believed that having the bonding layer no more than 4 inches on a traditional rifle barrel provides superior results.

While shown in FIG. 2 as being disposed at the second end 122 of the barrel 110, the bonding layer could be disposed at the first end 118 of the barrel, as is shown at 138*b*. In such a position, the heat from repeated firing of bullets would not effect the bonding layer 138 with as much intensity due to its remoteness from the point of firing. However, such a position of the bonding layer 138 leaves the second section 130*b* of the composite casing 130 and the second portion 114*b* of the metallic liner 114 unattached. This concern could be overcome by using a holding means such as a holding pin 140, or other similar device, to prevent rotation of the second section 130*b* of the casing 130 relative to the second portion 114*b* of the metallic liner 114.

As with the embodiment shown in FIG. 1, the embodiment of FIG. 2 includes a barrel mounting 144 at the second end 122 of the barrel 110, and a pre-stress insert 148 at the open first end 118.

Figure 3:
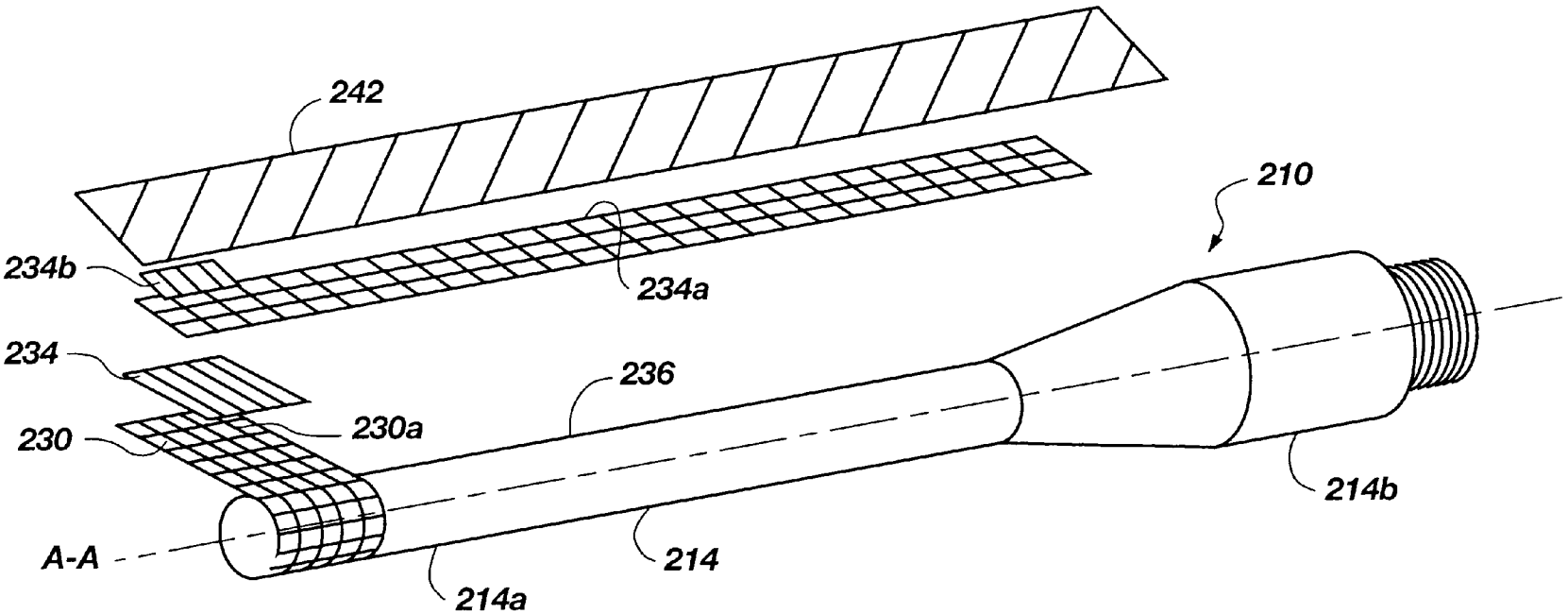
FIG. 3 shows a perspective view of a composite casing of a gun barrel being formed about a mandrel.

Referring now to FIG. 3, there is shown a perspective view of a barrel, generally indicated at 210 being formed from a metallic barrel liner 214 overlaid with a composite material 230. The composite material 230 will preferentially be a strip of fiberglass mesh about 26 inches long, which is commonly referred to as fiberglass scrim cloth. The fiberglass scrim cloth 230 may be preimpregnated with a resin or epoxy, i.e. "prepreg", or may be coated with resin or epoxy shortly before being placed on the metallic liner 214. The epoxy or resin connects the fiberglass fibers 230*a* of the scrim cloth 230 to form a nonconductive composite isolator or insulative layer between the metallic liner 214 and the remainder of the composite casing 30 (FIG. 1).

The scrim cloth 230 is covered with graphite fibers 234 to create a composite casing (30 in FIG. 1 and 130 in FIG. 2). The initial graphite layer 234 will typically be graphite tape which is hoop wound, i.e. wound about the metallic liner 214 generally perpendicular to the long axis A—A of the liner. Of course, the tape 234 could be wound in a helical pattern, or a single strand or roving of graphite could be used and would be wound at approximately 1–5 degrees from perpendicular to the long axis. Additionally, other composite materials may be used. Those skilled in the art will be familiar with the different techniques for winding prepreg tape 234 or single or multiple roving of graphite fiber impregnated with resin at application, as well as other forms of composite winding which may be used with the present invention.

Following the hoop wound layer 234, additional graphite fibers 234*a* are disposed along the metallic liner 214 in an axial or longitudinal direction generally parallel with the long axis of the metallic liner. After one or more layers (typically 5 to 15) of the axial fibers, another hoop wound layer 234*b* is applied. The process is then repeated for several alternating groups of hoop wound and axially placed layers. By controlling the number of hoop wound layers to the number of axially placed layers, the thermal expansion coefficient of the composite casing (30 in FIG. 1 and 130 in FIG. 2) can be controlled. The higher the number of hoop layers, the lower the coefficient of thermal expansion in a radial direction. However, stiffness in the direction (resistance to bending the barrel) is improved with increased quantity of axial fibers.

As the resin or epoxy impregnated tape 234 is overlaid on the metallic liner 214, the lining is or can be coated with a release agent to prevent the resin or epoxy from bonding with the liner. Preferentially, however, a release agent 236 is coated on the metallic liner 214 to prevent the epoxy or resin from bonding to the liner, or the bond is broken by a controlled use of heat and pressure as opposed to the heat and pressure introduced during use.

Once several alternating groups of hoop wound fibers and axially laid fibers are applied to the metallic liner 214, an overwrap 242 is placed about the composite/metallic gun barrel 210. The overwrap 242 can be a knitted or woven cloth, a camouflage or decorative cloth, plastic shrink tube, or a helical graphite/epoxy outer layer overwrap. The overwrap 242 helps to protect the fibers 230*a* and 230*b*, and allows an aesthetically pleasing finish to be formed on the outside of the gun barrel 210.

Figure 4:
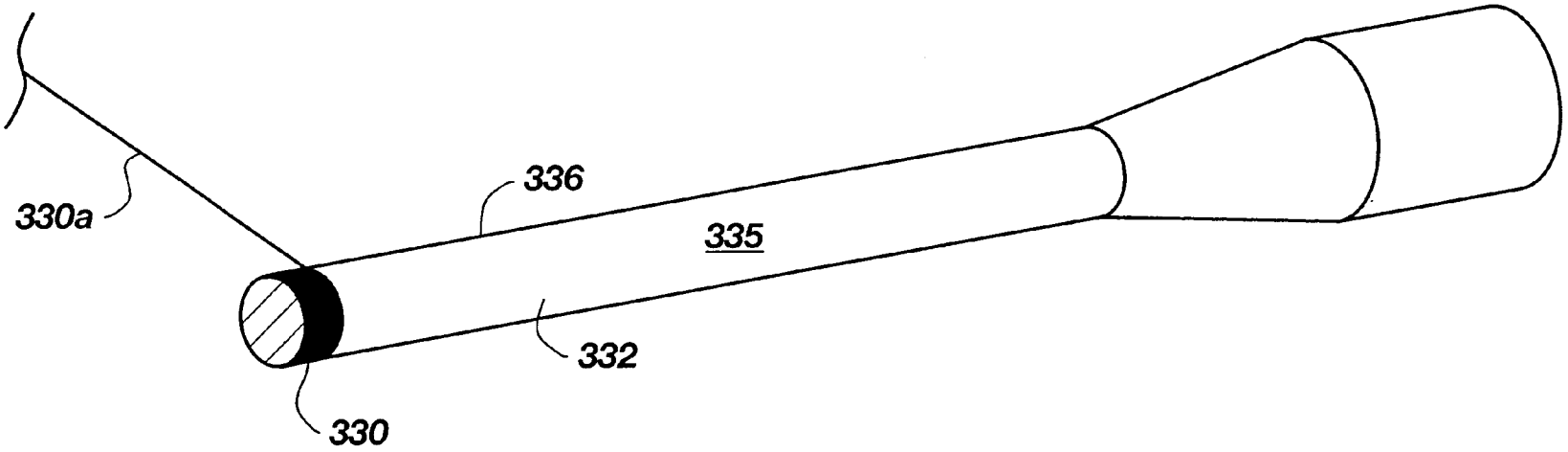
FIG. 4 shows a perspective view of a composite material being filament wound about a metallic barrel liner so as to form a metallic/composite gun barrel.

Referring now to FIG. 4, there is shown a perspective view of a composite portion 330 of a gun barrel being formed about a mandrel 335. Rather than using a graphite tape, such as that shown in FIG. 3, a single graphite thread 330*a* is wound about the fiberglass insulative layer 332 which is formed about the mandrel 335. This is typically accomplished by placing the mandrel 335 on a lathe (not shown) or similar machine, applying the fiberglass layer 332 and then rotating the mandrel at a high rate of speed. The resin or epoxy coated graphite forms a hoop wound layer. Longitudinal layers and additional hoop layers are applied to achieve a desired thickness.

Because the composite layer 330 will be removed after curing, a release layer 336 is typically applied to the mandrel 335 prior to applying the initial layer of fiberglass. Those skilled in the art will be familiar with such materials.

Once removed from the mandrel 335, the cured composite layer 330 and fiberglass 332 are slid over a metallic liner to form the barrel of a gun. Using a composite layer which has been cured on a mandrel 335 is advantageous in that failure to properly coat the metallic liner with a release agent could result in the composite portion being attached at undesirable locations to the composite casing. This in turn may cause warping as discussed above.

This concern is overcome when using the mandrel 335, as the bond between the mandrel 335 and the fiberglass layer of the composite casing must be broken to remove the mandrel. The mandrel 335 is also easier to work with, especially when applying a single graphite thread, and the risk of damaging the thin walls of the first portion (14*a* in FIG. 1 and 114*a* in FIG. 2) is not present.

An additional advantage of using the mandrel 335 is that it is substantially easier to apply a consistent, short bonding layer, such as bonding layer 138 in FIG. 2, when the composite casing is formed prior to being placed about the metallic liner. If the composite casing is formed on the liner, the maker must be careful that the release agent remains uniform and only on the areas along which the interface (34 in FIG. 1 and 134 in FIG. 2) between the casing and the liner are to remain nonbonded.

Thus there is disclosed a substantially nonbonded composite/metallic gun barrel. By maintaining 50 percent or more of the length of the barrel in an nonbonded state, a considerable improvement is made in avoiding warping of the gun barrel. Those skilled in the art will be familiar with numerous modifications which might be made to the present invention without departing from the scope or spirit of the same. The appended claims are intended to cover such modifications.

What is claimed is:

1. A gun barrel comprising:

an elongated metallic liner having an exterior circumference, and a first, thin walled portion and a second, thicker walled portion forming a chamber for holding a bullet;

an elongated, fiber and resin composite casing co-extensive in length with and disposed about the elongated metallic liner, the fiber and resin composite casing having an interior circumference; and an interface disposed at the interior circumference of the fiber and resin composite casing and the exterior circumference of the metallic liner and extending along the length of the fiber and resin composite casing, wherein the interface is characterized by the absence of bonding between the fiber and resin composite casing and the metallic liner for at least half of the length of the fiber and resin composite casing, and wherein at least a portion of the metallic liner and the fiber and resin composite casing are bonded at the interface along said second, thicker walled portion.

2. The gun barrel of claim 1, wherein the interface is characterized by an absence of bonding for the entire length of the fiber/resin composite casing.

3. The gun barrel of claim 1, wherein the gun barrel further comprises a bonding layer disposed at the interface for bonding the metallic liner to the fiber and resin composite casing, and wherein the bonding layer extends less than 4 inches along the interface.

4. The gun barrel of claim 3, wherein the bonding layer extends between about 2–3 inches along the interface.

5. The gun barrel of claim 4, wherein the gun barrel comprises a first, open end and a second end attachable to a gun stock, and wherein the bonding layer is disposed adjacent the second end of the gun barrel.

6. A gun barrel comprising:

an elongated metallic liner having an exterior circumference;

an elongated, fiber and resin composite casing co-extensive in length with and disposed about the elongated metallic liner, the fiber and resin composite casing having an interior circumference;

an interface disposed at the interior circumference of the fiber and resin composite casing and the exterior circumference of the metallic liner and extending along the length of the fiber and resin composite casing, and wherein the interface is characterized by the absence of bonding between the fiber and resin composite casing and the metallic liner for at least half of the length of the fiber and resin composite casing; and holding means disposed at the interface between the fiber and resin composite casing and the metallic liner so as to prevent rotation of the composite casing relative to the metallic liner.

7. The gun barrel of claim 6, wherein the holding means comprises a holding pin disposed partially in the metallic liner and partially in the fiber and resin composite casing.

8. A gun barrel comprising:

an elongated metallic liner having an exterior circumference;

an elongated, fiber and resin composite casing co-extensive in length with and disposed about the elongated metallic liner, the fiber and resin composite casing having an interior circumference;

an interface disposed at the interior circumference of the fiber and resin composite casing and the exterior circumference of the metallic liner and extending along the length of the fiber and resin composite casing, and wherein the interface is characterized by the absence of bonding between the fiber and resin composite casing and the metallic liner for at least half of the length of the fiber and resin composite casing;

an open, first end and a second end attachable to a stock; and a bonding layer disposed at the interface adjacent the open, first end for bonding the fiber and resin composite casing to the metallic liner, the bonding layer extending less than 4 inches along the interface.

9. The gun barrel of claim 8, wherein the bonding layer extends between 1 and 2 inches along the interface.

* * * * *